US006862425B2

(12) United States Patent
Behnke et al.

(10) Patent No.: US 6,862,425 B2
(45) Date of Patent: Mar. 1, 2005

(54) MICROWAVE DEVICE AND METHOD TO FUSE TONER ONTO PRINT SUBSTRATE

(75) Inventors: Knut Behnke, Kiel (DE); Hans-Otto Krause, Eckernfoerde (DE); Frank-Michael Morgenweck, Molfsee (DE); Domingo Rohde, Kiel (DE); Detlef Schulze-Hagenest, Molfsee (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/422,482

(22) Filed: Apr. 24, 2003

(65) Prior Publication Data

US 2004/0081493 A1 Apr. 29, 2004

(30) Foreign Application Priority Data

May 17, 2002 (DE) ..... 102 22 061

(51) Int. Cl.[7] ..... G03G 15/20

(52) U.S. Cl. ..... 399/336

(58) Field of Search ..... 399/336, 320, 399/335; 219/216, 678

(56) References Cited

U.S. PATENT DOCUMENTS 4,435,072 A 3/1984 Adachi et al.
6,665,516 B2 * 12/2003 Morgenweck et al. ..... 399/336

* cited by examiner

*Primary Examiner*—Quana Grainger
(74) *Attorney, Agent, or Firm*—Lawrence P. Kessler

(57) ABSTRACT

A microwave device 2 is provided for fusing toner onto a print substrate in a printing machine, with a device for generating a synchronized operation to increase the absorption of the microwave irradiation by the print substrate. The microwave energy is provided by the microwave device to the print substrate in the form of pulses and the absorption of the microwave radiation by the print substrate is increased.

4 Claims, 1 Drawing Sheet

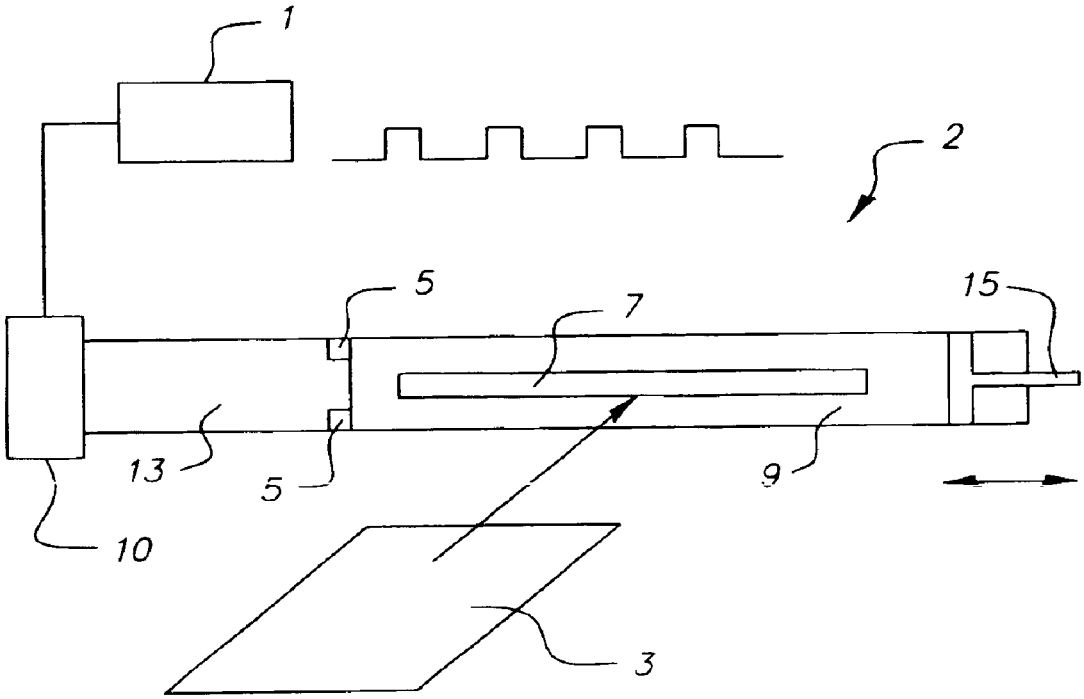
1
2
5
7
15
13
5
9
10
3

MICROWAVE DEVICE AND METHOD TO FUSE TONER ONTO PRINT SUBSTRATE

FIELD OF THE INVENTION

The invention relates to a microwave fusing of toner to a print substrate, wherein operation of microwaves is synchronized to increase absorption of the microwave irradiation by the print substrate.

BACKGROUND OF THE INVENTION

Microwave devices are used in many areas of technology. One application of microwaves is for example the heating of objects, such as microwave ovens in the household. A particular application concerns microwave devices as a fusing device in printing machines, whereby the image applied to a print substrate by a toner is fused to the print substrate by microwave irradiation and secured to it, whereby the toner is melted by the heating due to microwave energy and forms a substantial connection with the print substrate and is interlocked with it. The energy to be supplied for this fusing process is very high, caused in particular by the high speed with which the print substrate is passed through the microwave device, whereby, in the short fusing time that the print substrate spends in the microwave device, a high electrical power supply must be provided. Compared with the fusing of toner by means of rollers, or roller fusing, for the fusing by means of microwaves, or microwave fusing, approximately 20% to 50% more power per $cm^2$ is required.

SUMMARY OF THE INVENTION

The purpose of the invention is thus to provide an effective fusing of a toner onto a print substrate. According to the invention, a microwave device is provided with a printing machine for fusing toner onto print substrate, with a device for the generation of a synchronized operation to increase the absorption of the microwave irradiation by the print substrate. In addition, a method to fuse toner onto a print substrate in a printing machine is provided, whereby microwave energy is supplied from the microwave device to the print substrate in the form of pulses, and the absorption of the microwave irradiation by the print substrate is increased.

With a ratio of the cycle duration of a microwave pulse where the microwave power is not equal to zero, one half of the synchronized operation can be advantageously carried out in an interval in which the microwave power is equal to zero. Furthermore, a cycle frequency in the range of 1 Hz to 100 kHz, in particular from 0.5 kHz to 1 kHz, and a ratio of the microwave pulse to the pulse separation in the range of 0.1 to 100, in particular 0.3 to 3, can be used. These ranges have proved to be particularly effective. The microwave power in the synchronized operation (MLt) corresponds on the average to the microwave power (MLd) for the non-synchronized operation. The microwave power during a pulse separation is ideally zero.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

The lone FIGURE is a schematic view, of the microwave fusing device according to this invention.

DETAILED DESCRIPTION OF THE INVENTION

Referring now to the accompanying drawing, the FIGURE shows schematically, a view of a microwave device 2 with a control device 1 for generating a synchronized operation as an embodiment of the invention. The microwave device 2 is used to fuse toner onto a print substrate 3. On the left side of the microwave device 2, there is a magnetron 10 for generating microwaves. Attached to the magnetron 10 is a coupling transducer 13 for coupling microwaves in a resonating cavity 9. An aperture 5 is located between the coupling transducer 13 and the resonating cavity 9. The resonating cavity 9 has an opening 7 in the lateral surface for passing the print substrate 3 through the resonating cavity 9. The print substrate 3 is conducted through resonating cavity 9 in the direction indicated with an arrow.

On the opposite lateral surface of the resonating cavity 9, there is a corresponding opening to conduct the print substrate 3 through the resonating cavity 9. On the right side of the resonating cavity 9 of the microwave device 2, there is a sliding lock valve 15 made of metal. The lock value 15 can be moved in the horizontal direction with respect to the resonating cavity 9, and extends into the resonating cavity 9. The sliding lock valve 15 consists of a rod and a rectangular surface at the end of the rod, which is connected at right angles to the rod. The rectangular surface closes the resonating cavity 9 in such a manner that a good electrical contact between the sliding lock valve 15 and the interior surface of the resonating cavity 9 is provided.

The microwave device 2 is connected to the control device 1, which provides the microwave device 2 with a suitable electrical power supply. On the basis of the electrical power supply provided by the device 1, the magnetron 10 generates microwaves, which form a standing wave in the operating state in the resonating cavity 9. The standing microwave is reflected to the sliding lock valve 15. In the operating state, the print substrate 3 is conducted through the opening 7 through the resonating cavity 9. The toner lying on the print substrate 3 is fused to the print substrate 3 due to the heating effect of the microwaves. After leaving the resonating cavity 9, the toner is firmly attached to the print substrate 3.

The higher the power provided by the microwave device 2, the stronger the heating of the print substrate 3 and of the overlying toner. For this purpose, considerable microwave power is required, which is provided by device 1. It was discovered that the absorption of the microwaves by an object as a function of the microwave power supplied to the object is not linear. The absorption of the microwaves by the print substrate 3, which leads to the heating of the print substrate 3, is approximately proportional to the square of the electrical field strength of the microwave field.

In order to increase the efficiency of the power provided by the device 1, the device 1 of the microwave device 2 makes two electrical pulses available, from which ten microwave pulses are generated in the magnetron. During one pulse, a microwave is formed in the resonating cavity 9, through which the print substrate 3 is conducted. The pulses alternate with pulse separations during which ideally, when the microwave power is equal to zero, no microwave field is formed in the resonating cavity 9.

The microwave field is formed in the field of the resonating cavity 9. This is designated in the existing description as a synchronized operation. The advantage that lies herein is that, with the same energy supply of the device 1 to the microwave device 2, a significantly higher energy absorption by the print substrate 3 takes place. In comparison to the uniform energy supply with a uniform electrical power supply, in which the same amount of energy is supplied, for example, as with the synchronized operation, the pulses lead to a higher microwave power. On the basis of the principle discovered, according to which the absorption of the microwave energy by the print substrate 3 is proportional to the square of the electrical field strength, the energy supplied during the synchronized operation is substantially better used, since the electric field strength is proportional to the microwave power.

Under suitable boundary conditions, an increase in the absorption of the microwave energy by more than the factor of two can be achieved, which is comparable to the microwave devices for fusing toner onto the print substrate 3 of the state of the art. On this premise, that the microwave power during the pulse separation is equal to zero, there is an increase in the absorption of the microwave power by the print substrate 3 that is comparable to the absorption of the microwave power for the normally non-synchronized operation. The sufficient fusing of the toner onto the print substrate 3 is thus guaranteed in the synchronized operation with a substantially reduced power supply than in the prior state of the art.

Another suitable boundary condition to achieve the highest absorption of microwaves in terms of the power supplied, is a higher signal level swing of the device 1, whereby minimum power is set during a pulse separation and maximum power during a pulse. In addition, the width of the resonating cavity 9, through which the print substrate 3 is conducted, must be observed, as well as the speed or traverse speed of the print substrate 3. With an exemplary embodiment of the invention, the synchronized operation with the ratio of the time of an electric pulse from device 1, provided by the microwave when the microwave power is not equal to zero, to the duration of a pulse separation, when the microwave power is equal to zero, a ratio of one is selected. This means that an electric pulse is followed by a pulse separation that has the same pulse length.

Then the microwave power corresponds in synchronized operation on the average to the microwave power that is in non-synchronized operation. The microwave power during a pulse separation amounts in this example ideally to double the microwave power for the non-synchronized operation. The microwave power during a pulse separation ideally amounts to zero. Furthermore, a ratio of the duration of the microwave pulse to the duration of pulse separation is in the range of 0.1 to 100, in particular, from 0.3 to 3 is used. The cycle frequency of the device 1 lies in the range from 1 Hz to 100 kHz, in particular, from 0.5 kHz to 1 kHz.

In addition, it is provided that the ratio of the duration of the microwave pulse to the duration of the pulse separation is to be selected as a function of the type of print substrate. With the supply of a different print substrate 3 to the digital printing machine, the ratio of electrical pulses to pulse separations on the device 1 is changed accordingly. If, for example, a print substrate 3 with a lower mass per unit area is provided, the pulse/pulse separation ratio changes from one to one-half, i.e., after a pulse, which leads to a standing microwave in the resonating cavity 9, two pulse separations follow, which each have the same length as the pulse. In this manner, the electrical field strength is changed, and the absorption of microwave energy by such different print substrate 3 is adjusted to another print substrate 3 with a lower mass per unit area. In a similar manner, an adjustment is made to the various print substrate materials, which the microwave irradiation absorbs to differing degrees.

The invention has been described in detail with particular reference to certain preferred embodiments thereof, but it will be understood that variations and modifications can be effected within the spirit and scope of the invention.

What is claimed is:

1. Microwave device for fusing toner onto a print substrate (3) on a printing machine, comprising: a control device (1) for generating a synchronized operation of microwaves to increase the absorption of the microwave irradiation by the print substrate (3), said control device including a microwave generating device, wherein a synchronized operation with a ratio of the duration of the microwave pulse, in which the microwave power is not equal to zero, to a duration of a pulse separation, in which the microwave power is equal to zero, is one-half.

2. Method for fusing toner onto print substrate (3) in a printing machine, comprising the steps of: supplying microwave energy to the print substrate (3) in the form of pulses, and synchronizing such pulses such that the absorption of the microwave irradiation by the print substrate (3) is increased, wherein a synchronized operation with a ratio of the duration of the microwave pulse, in which the microwave power is not equal to zero, to a duration of a pulse separation, in which the microwave power is equal to zero, is one-half.

3. Method according to claim 2, wherein a pulse cycle frequency of the microwaves is in the range of 1 Hz to 100 kHz, in particular from 0.5 kHz to 1 kHz, and a ratio of the duration of microwave pulses to the duration of pulse separations is in the range of 0.1 to 100, in particular from 0.3 to 3.

4. Method according to claim 2, wherein the ratio of the duration of the microwave pulses to the duration of the pulse separations is selected as a function of the type of print substrate.

* * * * *